US011311990B2

(12) United States Patent
Rosales

(10) Patent No.: US 11,311,990 B2
(45) Date of Patent: Apr. 26, 2022

(54) RATCHET WRENCH

(71) Applicant: Klein Tools, Inc., Lincolnshire, IL (US)

(72) Inventor: Raul Rosales, Mansfield, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 299 days.

(21) Appl. No.: 16/454,646

(22) Filed: Jun. 27, 2019

(65) Prior Publication Data

US 2020/0406436 A1 Dec. 31, 2020

(51) Int. Cl.
*B25B 23/16* (2006.01)
*B25B 13/46* (2006.01)

(52) U.S. Cl.
CPC ..... *B25B 23/16* (2013.01); *B25B 13/463* (2013.01)

(58) Field of Classification Search
CPC ..... B25B 23/16; B25N 13/463
See application file for complete search history.

(56) References Cited

U.S. PATENT DOCUMENTS 429,034 A * 5/1890 Justice ..... B25B 13/463 81/62
5,095,781 A * 3/1992 Blake ..... B25B 13/461 16/422
9,027,444 B2 * 5/2015 Chang ..... B25B 13/06 81/60
9,038,508 B1 * 5/2015 Hodges ..... B25B 13/463 81/63.1
10,414,029 B2 * 9/2019 Mills ..... B25B 13/463
2020/0282544 A1 * 9/2020 Barongan ..... B25B 23/16

* cited by examiner

*Primary Examiner* — Hadi Shakeri

(57) ABSTRACT

A ratchet wrench includes a fastener drive member and a rigid, one-piece frame having a handle portion extending along a longitudinal frame axis between a head portion and a finger loop. The fastener drive member has a pair of drive openings centered on the drive axis and facing in opposite directions, with each of the drive openings defined by one or more drive surfaces. One of the drive openings is sized to receive a fastener or driver bit of a first size and the other opening is sized to receive a fastener or driver bit of a second size greater than the first size. The finger loop has a finger receiving opening sized to receive and encircle a finger of a user. The fastener drive member is mounted in the head portion to rotate about a drive axis, and a ratchet mechanism is mounted in the head portion in operable connection to the fastener drive member to selectively transfer torque from the frame to the fastener drive member in either a clockwise or counterclockwise direction about the drive axis.

9 Claims, 6 Drawing Sheets

RATCHET WRENCH

CROSS-REFERENCE TO RELATED APPLICATIONS

None

BACKGROUND OF THE DISCLOSURE

The present disclosure relates to ratchet wrenches, and more particularly to ratchet wrenches capable of use on fasteners located in tight or confined spaces.

People who provide repair or installation services in certain industries are often faced with the need to install, tighten or loosen threaded fasteners that are located in tight or confined spaces that make it difficult to operate a standard hand tool. One such industry is the heating and cooling industry where the fasteners within furnaces and utilized for duct work are often located in tight, confined spaces that make it difficult for the service person who must install, tighten, and/or loosen the fasteners.

Accordingly, there is a need for a hand tool that reduces the difficulty in installing, tightening, and/or loosening fasteners located in tight, confined spaces.

BRIEF SUMMARY OF THE DISCLOSURE

In accordance with one feature of this disclosure, a ratchet wrench is adapted to be operated in confined spaces and includes a fastener drive member, a reversible ratchet mechanism, and a rigid, one-piece frame having a handle portion extending along a longitudinal frame axis between a head portion and a finger loop. The fastener drive member has a pair of drive openings centered on the drive axis and facing in opposite directions, with each of the drive openings defined by one or more drive surfaces. One of the drive openings is sized to receive a fastener or driver bit of a first size and the other opening is sized to receive a fastener or driver bit of a second size greater than the first size. The finger loop has a finger receiving opening sized to receive and encircle a finger of a user. The fastener drive member is mounted in the head portion to rotate about a drive axis, and the ratchet mechanism is mounted in the head portion in operable connection to the fastener drive member to selectively transfer torque from the frame to the fastener drive member in either a clockwise or counterclockwise direction about the drive axis.

As one feature, one of the drive openings of the fastener drive member is configured to engage a ¼ inch hexagonal drive portion on a fastener or drive bit, and the other drive opening of the fastener drive member is configured to engage a 5/16 inch hexagonal drive portion on a fastener or drive bit.

In one feature, the wrench further includes a magnet located in the fastener drive member between the openings. As a further feature, the magnet has a through bore centered on the drive axis. In another feature, the magnet has a cylindrical outer surface centered on the drive axis. In yet a further feature, the wrench further includes a magnet housing, the magnet is mounted in the housing and the magnet housing has an interference fit with the fastener drive member.

According to one feature, the fastener drive member includes a thumb wheel having a diameter transverse to the drive axis that is greater than a maximum width of the head portion transverse to the frame and drive axes.

As one feature, the head portion has a maximum width transverse to the frame and drive axes, the finger receiving opening has a maximum width transverse to the frame and drive axes that is greater than the maximum width of the head, the maximum width of the head portion is no greater than ⅞ inch, and the maximum width of the finger receiving opening is no less than ⅞ inch. In a further feature, at least part of the handle portion has a width transverse to the frame and drive axes that is less than the maximum width of the head portion.

In one feature, the finger receiving opening has a circular shape.

According to one feature, the finger loop has an arcuate outer surface that partially surrounds the finger receiving opening.

In accordance with one feature of this disclosure, a ratchet wrench is adapted to be operated in confined spaces and includes a fastener drive member, a magnet, a reversible ratchet mechanism, and a rigid, one-piece frame having a handle portion extending between a head portion and a finger loop. The fastener drive member has a pair of drive openings centered on the drive axis and facing in opposite directions, each of the drive openings defined by one or more drive surfaces. One of the drive openings is sized to receive a fastener or driver bit of a first size and the other opening is sized to receive a fastener or driver bit of a second size greater than the first size. The magnet is located in the fastener drive member between the openings. The finger loop has a finger receiving opening sized to receive and encircle a finger of a user. The fastener drive member is mounted in the head portion to rotate about a drive axis, and the ratchet mechanism is mounted in the head portion in operable connection to the fastener drive member to selectively transfer torque from the frame to the fastener drive member in either a clockwise or counterclockwise direction about the drive axis.

In accordance with one feature of this disclosure, a ratchet wrench is adapted to be operated in confined spaces and includes a fastener drive member having a pair of drive openings centered on the drive axis and facing in opposite directions, with one of the drive openings being configured to engage a ¼ inch hexagonal portion on a fastener or drive bit, and the other drive opening of the fastener drive member being configured to engage a 5/16 inch hexagonal portion on a fastener or drive bit. The ratchet wrench further includes a rigid, one-piece frame having a handle portion extending between a head portion and a finger loop, with the finger loop having a finger receiving opening sized to receive and encircle a finger of a user. The fastener drive member is mounted in the head portion to rotate about a drive axis, and a ratchet mechanism is mounted in the head portion in operable connection to the fastener drive member to selectively transfer torque from the frame to the fastener drive member in either a clockwise or counterclockwise direction about the drive axis.

DETAILED DESCRIPTION OF PREFERRED EMBODIMENTS

Figure 1:
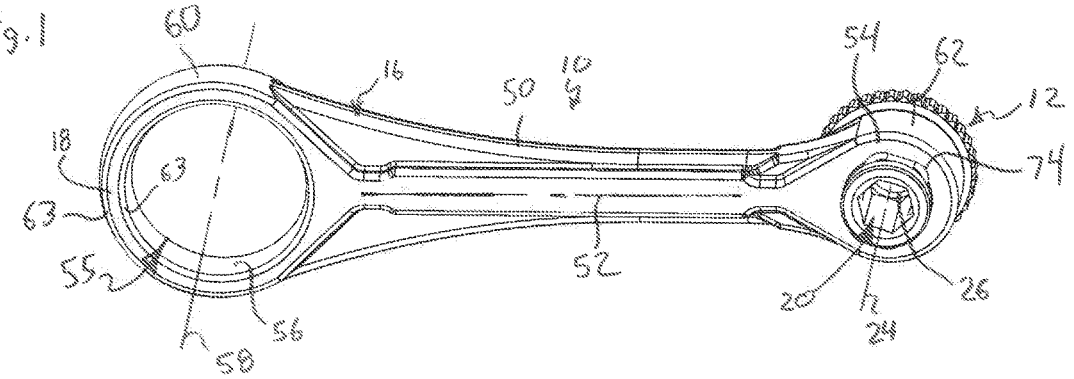
FIG. 1 is a perspective view from the rear and right side of a ratchet wrench according to this disclosure.

As best seen in FIGS. 1-8, a ratchet wrench 10 is provided for installing, tightening, and/or lessening fasteners located in tight, confined spaces. The wrench 10 includes a fastener drive member 12, a reversible ratchet mechanism 14, and a rigid, one-piece frame 16 (i.e., formed from one continuous piece of material) having a finger loop 18 for receiving a finger of a user to allow the user to repeatedly apply a drive torque to the wrench 10. The fastener drive member 12 includes a pair of drive openings 20 and 22 centered on a drive axis 24 and facing in opposite directions, with the opening 20 sized to received a fastener or driver bit of a first size and the opening 22 sized to receive a fastener or driver bit of a second size that is greater than the first size. The drive member 12 further includes a magnet 26 to retain fasteners and/or driver bits when they are received in either of the openings 20 and 22.

Figure 8:
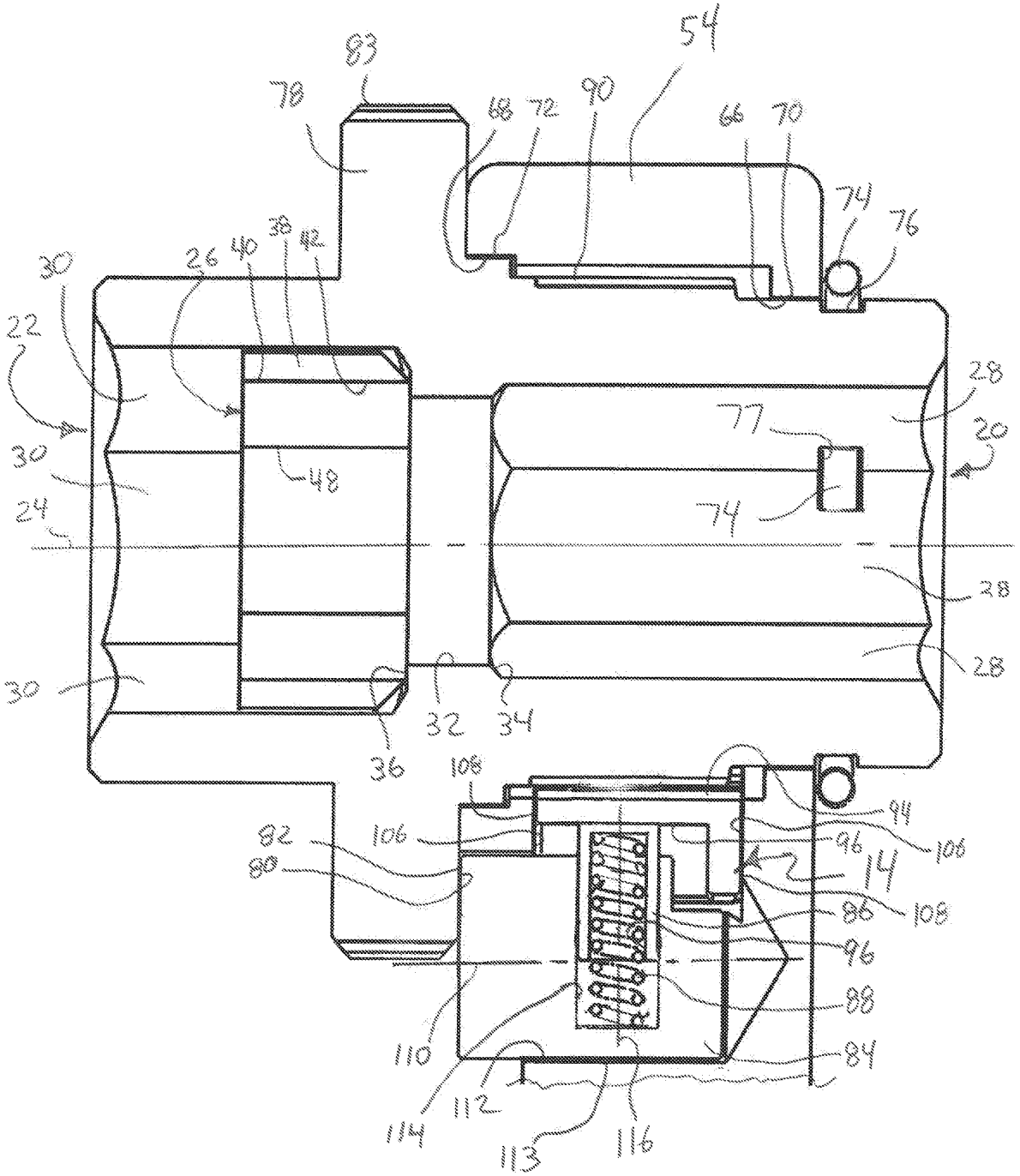
FIG. 8 is a partial section view taken along line 8-8 in FIG. 3.

In the illustrated and highly preferred embodiment of the drive member 12, the opening 20 is configured to engage a ¼ inch hexagonal drive portion on a fastener or driver bit and the opening 22 is configured to engage a 5⁄16 inch hexagonal drive portion on a fastener or driver bit. In this regard the opening 20 is defined by 6 drive surfaces 28 and the opening 22 is defined by 6 drive surfaces 30 that engage corresponding drive surfaces on a fastener or driver bit engaged in one of the openings 20 and 22 to transfer a drive torque from the drive member 12 to the fastener or driver bit. While the ¼ inch and 5⁄16 inch hexagonal drive configurations are highly preferred, in some application it may be desirable for other sizes and/or other drive configurations to be utilized, such as, for example, a ½ inch or ¾ inch square drive. As best seen in FIG. 8, in the illustrated embodiment, the drive member 12 is a unitary, one-piece construction (i.e., formed from a single, continuous piece of material), with an radially inwardly directed annular rib 32 centered on the axis 24 and located between the openings 20 and 22. The rib 32 defines a shoulder 34 at the bottom of the opening 20 and an oppositely facing shoulder 36 at the bottom of the opening 22.

Figure 9:
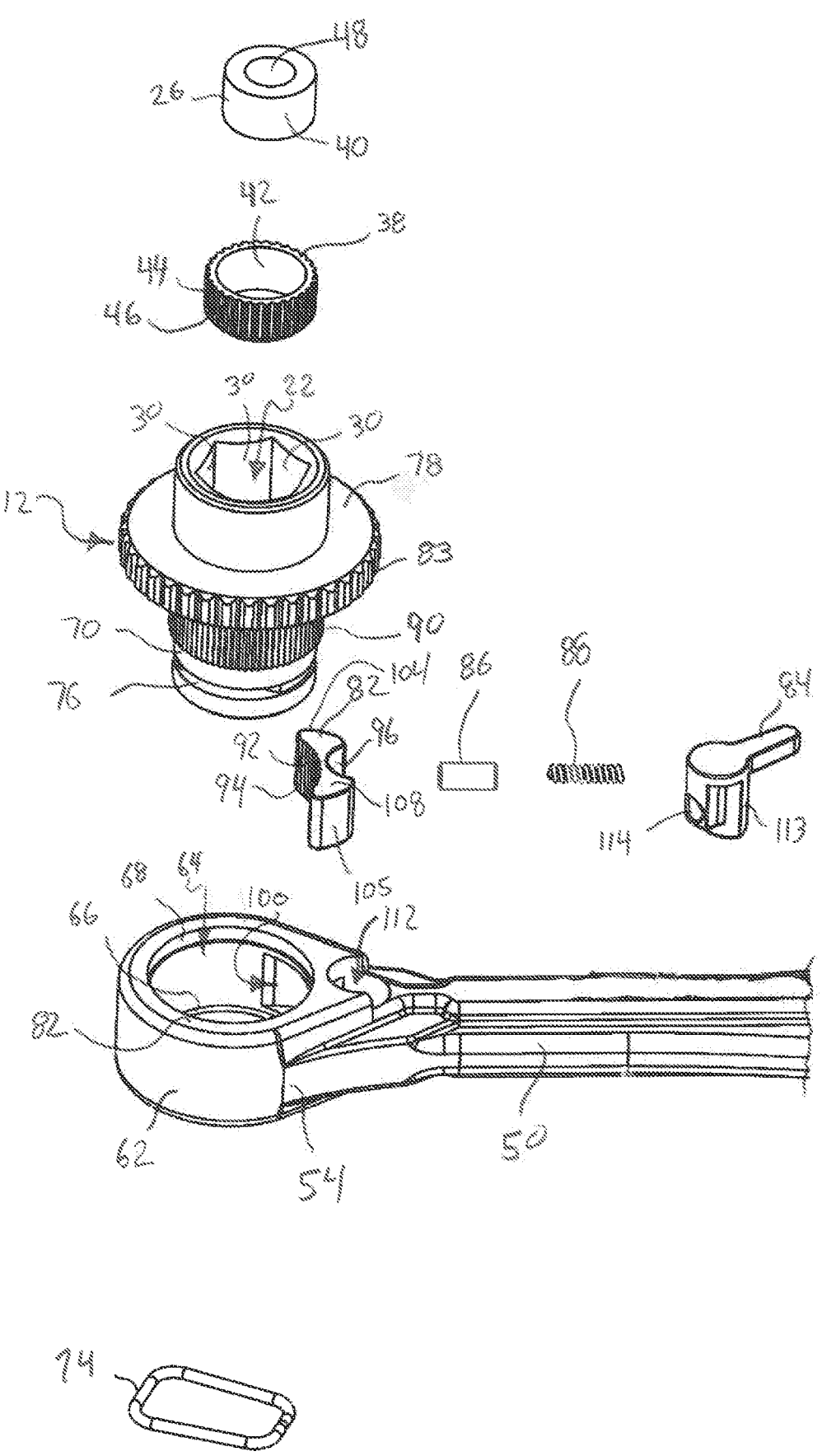
FIG. 9 is an exploded perspective view from the front and left side of the ratchet wrench of FIG. 1.
Figure 10:
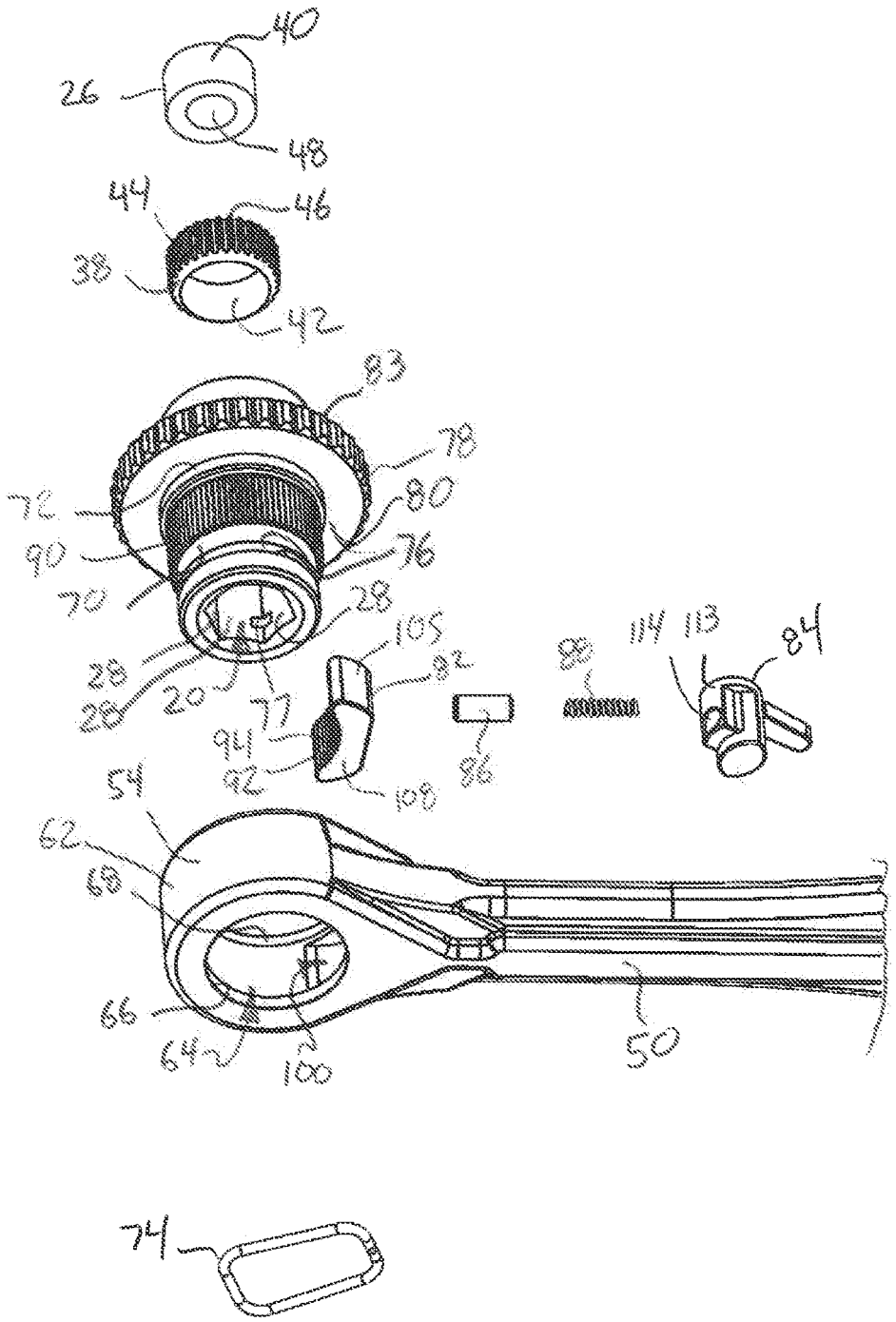
FIG. 10 is an exploded perspective view from the rear and left side of the ratchet wrench of FIG. 1.

As best seen in FIG. 8, the magnet 26 is mounted in the drive member 12 between the openings 20 and 22. In the illustrated embodiment, the magnet 26 is mounted in a magnet housing 38. In this regard, as best seen in FIG. 8, the magnet 26 has a cylindrical outer surface 40 that has a close fit or interference fit with a cylindrical through bore 42 formed in the housing 38. In the case of a close fit, the magnet can be bonded into the bore 42 using any suitable bonding agent. As best seen in FIGS. 9 and 10, the housing 38 has a cylindrical shaped outer surface 44 that has axial serrations or teeth 46 formed thereon. The outer surface 44 and teeth 46 are sized to form an interference fit with the surfaces 30 of the opening 22. In the illustrated embodiment, the magnet 26 has a cylindrical through bore 48 that allows a user to push a "stuck" fastener or driver bit out of engagement with one of the openings 20 or 22 by inserting a push tool through the opposite one of the openings 20 and 22.

Figure 2:
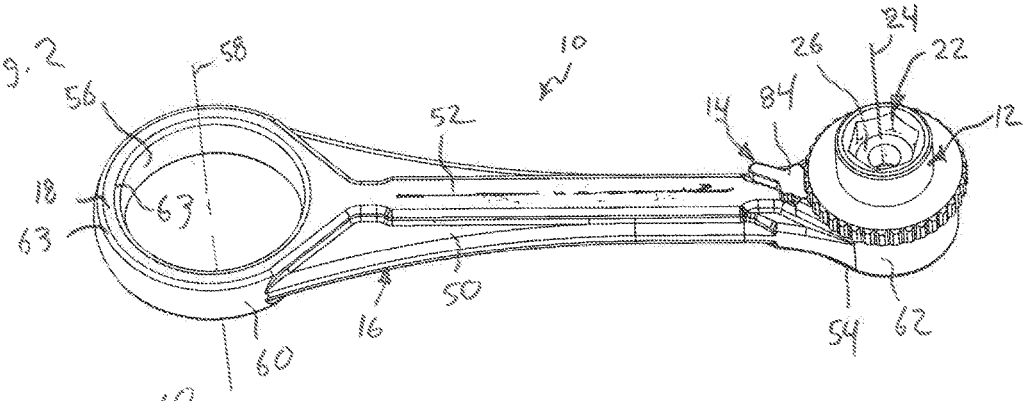
FIG. 2 is a perspective view from the front and right side of the ratchet wrench of FIG. 1.
Figure 3:
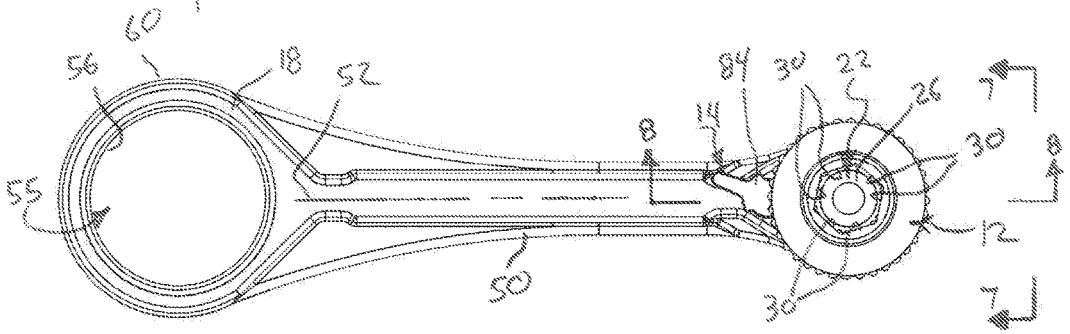
FIG. 3 is a front plan view of the ratchet wrench of FIG. 1.
Figure 4:
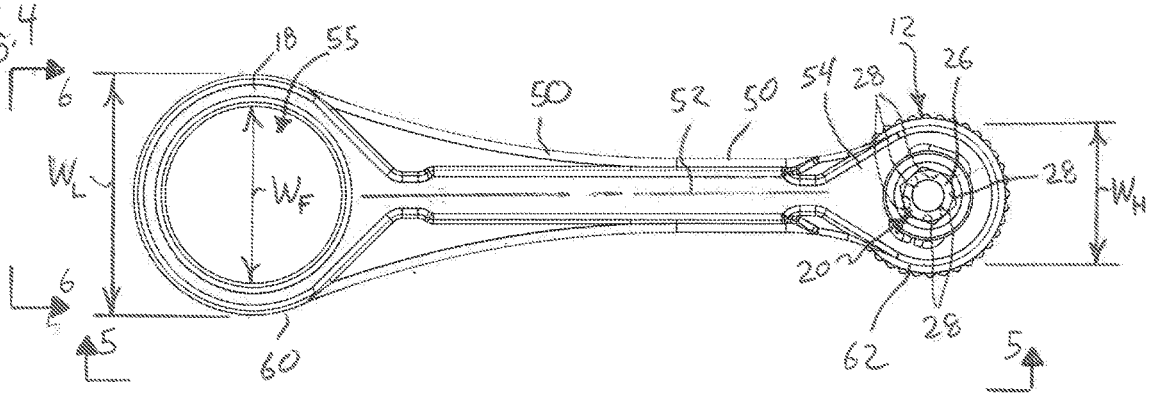
FIG. 4 is a rear plan view of the ratchet wrench of FIG. 1.
Figure 5:
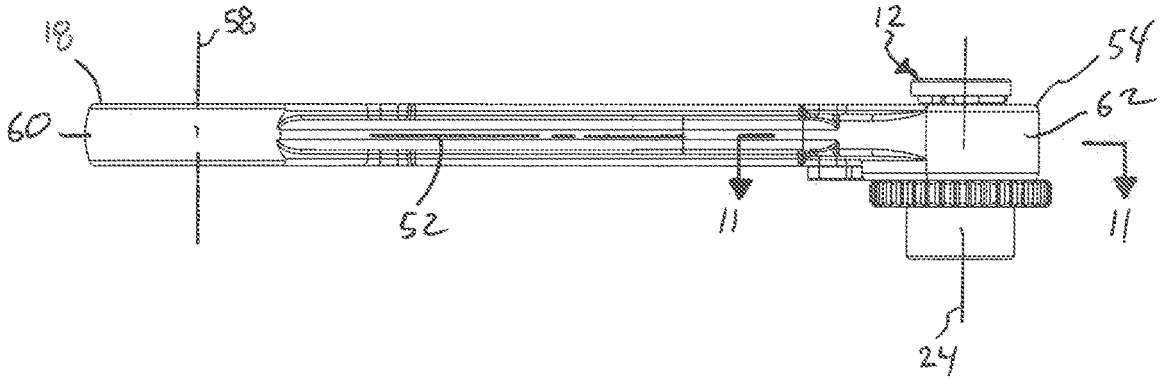
FIG. 5 is a view taken from line 5-5 in FIG. 4.
Figure 6:
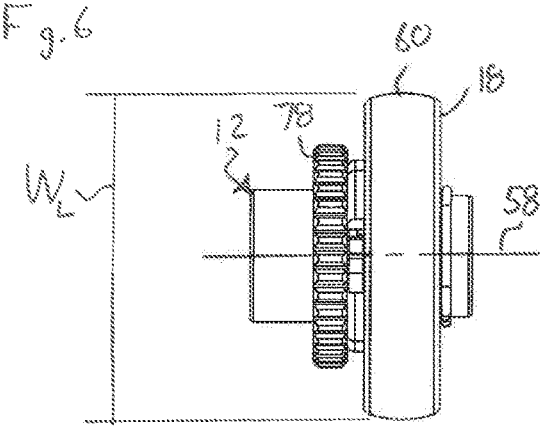
FIG. 6 is a view taken from line 6-6 in FIG. 4.
Figure 7:
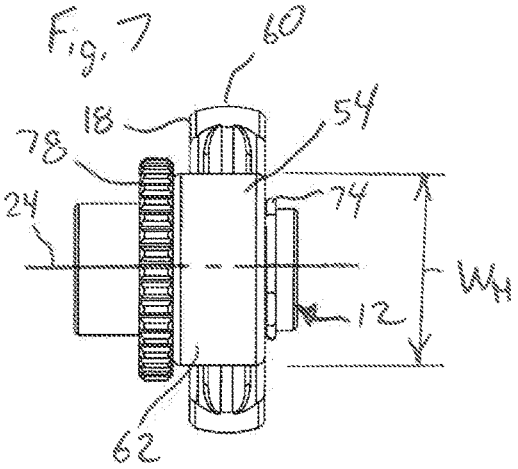
FIG. 7 is a view taken from line 7-7 in FIG. 3.

As best seen in FIGS. 1-7, the frame 16 has a handle portion 50 extending along a longitudinal frame axis 52 between the finger loop 18 and a head portion 54. The finger loop 18 has a finger receiving opening 55 sized to receive and encircle a finger of a user. In this regard, during operation, a user can either insert a single finger into the opening 55 or pinch a finger and a thumb into the opening 55 to apply a torqueing force to the wrench 10 while allowing the finger loop 18 to slide relative to the finger and/or thumb when driving a fastener or driver bit. In the illustrated and preferred embodiment, the opening 55 is defined by a cylindrical surface 56 centered on a loop axis 58 that extends parallel to the drive axis 24 and transverse to the frame axis 52. As best seen in FIGS. 4 and 7, the head portion 54 has a maximum width $W_H$ transverse to the frame axis 52 and the drive axis 24. Similarly, as best seen in FIG. 4, the finger loop 18 has a maximum width $W_L$ and the finger receiving opening 54 has a maximum width $W_F$ transverse to the axes 24, 52, and 56. Preferably, the maximum widths $W_L$ and $W_F$ are greater than the maximum width $W_H$, the maximum width $W_H$ is no greater than ⅞ inch, and the maximum width $W_F$ is no less than ⅞ inch. The width of the handle portion 50 transverse to the axes 24, 52, and 56 is less than the maximum width $W_L$ over the entire length of the handle portion 50 and at least a part of the length of the handle portion 50 has a width that is less than the maximum width $W_H$ of the head portion 54. Additionally, it is preferred that the overall length of the wrench along the axis 52 be in the range of 3 inches to 6 inches to provide the best one-handed functionality of the wrench 10 for a user. The overall length of the wrench in the illustrated embodiment is 4.26 inches. In the illustrated embodiment, the finger loop 18 has a cylindrical shaped outer surface 60 that blends into the handle portion 50 and the head portion 54 has a cylindrical shaped outer surface 62 that blends into the handle portion 50. As best seen in FIGS. 1 and 2, the finger loop 18 preferably has radiused annular edged 63 that blend into the surfaces 56 and 62 to provide better comfort to a user and to minimize the possibility of damaging a user's fingers.

Figure 11:
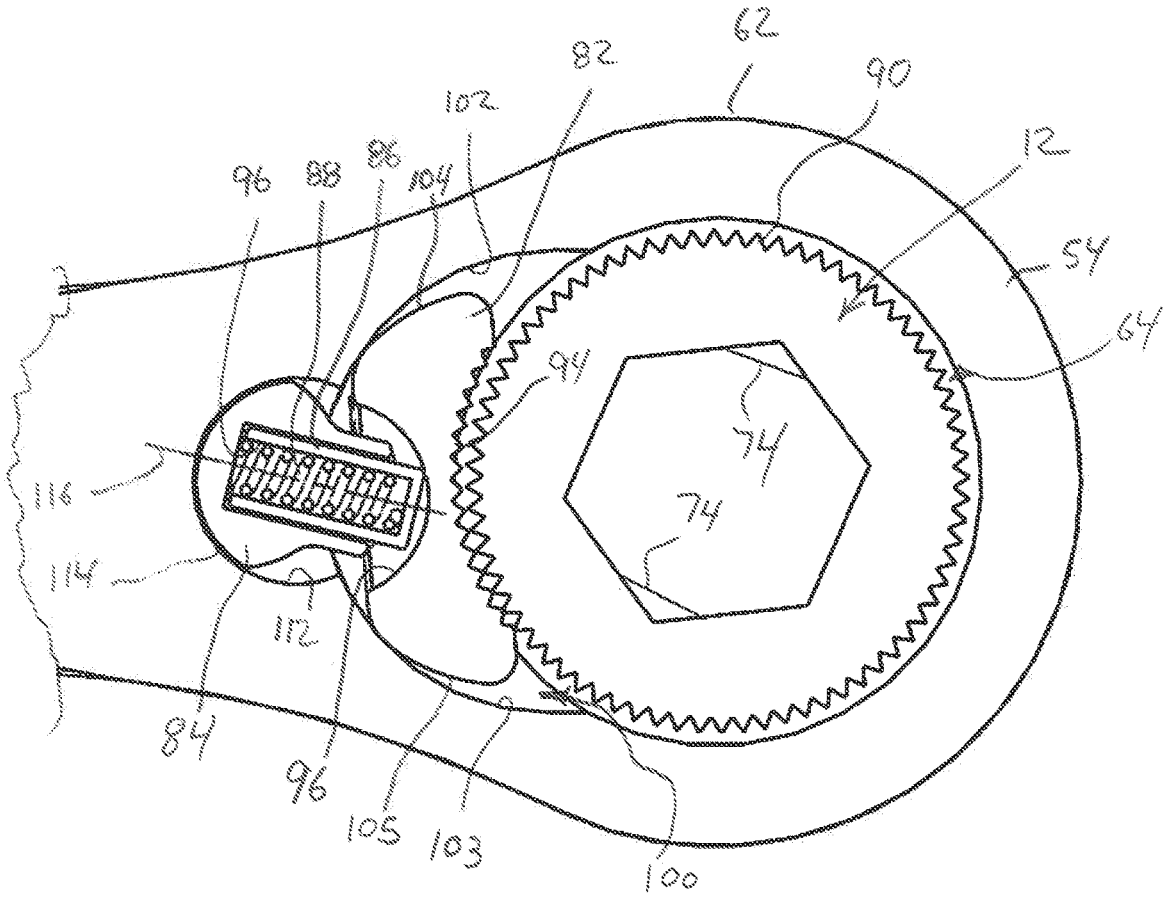
FIG. 11 is a partial section view taken along line 11-11 in FIG. 5.

As best seen in FIGS. 8-10, the head portion 54 has a through bore 64 that receives the drive member 12. The through bore 64 includes a pair of spaced cylindrical surfaces 66 and 68 centered on the drive axis 24 that have a close, rotational fit with mating cylindrical surfaces 70 and 72, respectively, on the drive member 12 to mount the drive member for rotation about the drive axis 24 relative to the frame 16. A spring clip 74 engages in a groove 76 formed in the drive member 12 to retain the drive member 12 in the head portion 54. In a preferred embodiment and as best seen in FIGS. 8, 10, and 11, the groove 76 breaks through into the opening 20 to form windows 77 that allow portions of the spring clip 74 to extend into the opening 20 to engage against and releasably retain a fastener or driver bit received in the opening 20. The drive member 12 includes a thumb wheel 78 having an annular face 80 that abuts an annular face 82 on the head portion 54 to limit movement of the drive member 12 along the drive axis 24. The thumb wheel 78 has an outside diameter that is greater than the maximum width $W_H$ and, preferably, includes serrations or teeth 83 to improve the engagement contact between the thumb wheel 78 and the thumb or finger of a user.

As best seen in FIGS. 8-11, the ratchet mechanism 14 is mounted in the head portion 54 and includes a pawl component 82, a user operated selector switch 84, a cam pin 86, a helical compression spring 88, and ratchet teeth 90 formed the fastener drive 12. The pawl component 82 includes a toothed, arcuate surface 92 including pawl teeth 94 configured to selectively mate with the teeth 90. The pawl component 82 further includes a concave cam surface 96 for engagement with the cam pin 86 and the cam pin 86 is biased into engagement with the surface 96 by the spring 88, which is received within a cylindrical bore 98 formed in the cam pin 86. The pawl component 82 is carried in a concave relief or slot 100 (best seen in FIGS. 9 and 10) formed in the head portion 54. As best seen in FIG. 11, the slot 100 has a pair of arcuate surfaces 102 and 103 that engage arcuate surfaces 104 and 105, respectively, on the pawl component 82 to guide the motion of the pawl component 82 relative to the head portion 54. As best seen in FIG. 8, planar side walls 106 in the slot 100 engage oppositely facing planar side walls 108 on the pawl component 82 to restrict axial movement of the pawl component 82 relative to the head portion 54. The selector switch 84 is mounted in the head portion to pivot about a pivot axis 110 (shown in FIG. 8) that extends parallel to the drive axis 24. In this regard, the head portion includes a cylindrical bore 112 centered on the pivot axis 110 and sized to rotatably receive a radially outwardly facing cylindrical surface 113 formed on the selector switch 84. The selector switch 84 includes a cylindrical bore 114 centered on an axis 116 that extends transverse to the pivot axis 110 and that is sized to receive the cam pin 86 for guided translation of the cam pin 86 along the axis 116 relative to the selector switch 84 and the head portion 54. The spring 88 forces the cam pin 86 against the pawl component 82 which results in the teeth 90 and 94 being biased into engagement. It is preferred that the selector switch 84 be mounted on the same side of the wrench 10 as the thumb wheel 78 and/or the larger of the openings 20 and 22 to reduce the possibility that a user will accidentally actuate the selector switch 84 when driving/rotating a fastener with the wrench 10. Additionally, the thumb wheel serves as an additional "stop" that restrict movement of the selector switch 84 out of the bore 112.

As best seen in FIGS. 8 and 11, in operation the selector switch 84 can be pivoted about the pivot axis 110 between a first position wherein the ratchet mechanism 14 allows the drive member 12 to rotate about the drive axis 24 in a clockwise direction while preventing the drive member 12 from rotating in a counterclockwise direction relative to the head portion 54, and a second position wherein the ratchet mechanism 14 allows the drive member 12 to rotate about the drive axis 24 in a counterclockwise direction while preventing the drive member 12 from rotating in a clockwise direction relative to the head portion 54. In the first position the cam pin 86 forces the pawl component 82 to the right side of the slot 100 as viewed in FIG. 11 so that when the drive member 12 is rotated clockwise relative to the frame 16 the mating teeth 90 and 94 push the pawl component 82 away from the drive member 12, compressing the spring 88 until the teeth 90 can rotate past the teeth 94. When the drive member 12 is rotated counterclockwise with the selector switch 84 in the first position and the pawl component 82 forced to the right side of the slot 100, the mating teeth 90 and 94 wedge the surfaces 103 and 105 against each other which forces the teeth 90 and 94 into tighter engagement and prevents the drive member 12 from further counterclockwise rotation relative to the frame 16. In the second position the camp pin 86 forced the pawl component 82 to the left side of the slot 100 as viewed in FIG. 11 so that when the drive member 12 is rotated counterclockwise relative to the frame 16, the mating teeth 90 and 94 push the pawl component 82 away from the drive member 12, compressing the spring 88 until the teeth 90 can rotate past the teeth 94. When the drive member 12 is rotated clockwise with the selector switch 84 in the second position and the pawl component 82 forced to the left side of the slot 100 as viewed in FIG. 11, the mating teeth 90 and 94 wedge the surfaces 102 and 104 against each other which forces the teeth 90 and 94 into tighter engagement and prevents the drive member 12 from further clockwise rotation relative to the frame 16.

Suitable materials can be utilized for each of the components disclosed herein and the selection of such materials is well within the capability of those skilled in the art. For example, a suitable steel material can be utilized for each of the components, 12, 16, 38, 74, 82, 84, 86, and 88.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the wrench 10 are shown in the figures, it should be understood that this disclosure anticipates variations in the specific details of each of the disclosed components and features of the wrench 10 and that no limitation to a specific form, configuration, or detail is intended unless expressly and specifically recited in an appended claim.

For example, while specific and preferred forms have been shown for the ratchet mechanism 14, any suitable ratchet mechanism, many of which are known, can be utilized with the other features of the wrench 10 disclosed herein. As another example, while the drive member 12 has been shown as a single, unitary component, in some applications it may be desirable for the drive member 12 to be composed of multiple components that are fixed together. In this regard, for example, it may be desirable for the teeth 90 to be formed on a ratchet wheel component that is then fixed to the remainder of the drive member 12. As another example, it may be desirable for the thumb wheel 78 to be formed as a separate component that is then fixed to the remainder of the drive member 12. In a further example, while a thumb wheel 78 is preferred, it may be desirable in some application for the wrench 10 to have no thumb wheel. In another example of alternate components, in some applications it may be desirable to eliminate the magnet housing 38 and to mount the magnet 26 directly into the drive member 12. As yet another example, while a specific type and configuration of spring clip 74 and mating slot 76 have been shown, in some applications it may be desirable for a different type and configuration of spring clip and mating slot to be utilized, many or which are known, or for an entirely different type of axial retainer to be used. As an additional example, while the circular shape of the finger receiving opening 55 is highly preferred, other shapes may be desired, such as, for example, oval.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. A ratchet wrench adapted to be operated in confined spaces the ratchet wrench comprising:

a fastener drive member having a pair of drive openings centered on a drive axis and facing in opposite directions, each of the drive openings defined by one or more drive surfaces, one of the drive openings sized to receive a fastener or driver bit of a first size and the other opening sized to receive a fastener or driver bit of a second size greater than the first size;

a reversible ratchet mechanism;

a rigid, one-piece frame having a handle portion extending along a longitudinal frame axis between a head portion and a finger loop, the finger loop having a finger receiving opening sized to receive and encircle a finger of a user, the fastener drive member mounted in the head portion to rotate about the drive axis, and the ratchet mechanism mounted in the head portion in operable connection to the fastener drive member to selectively transfer torque from the frame to the fastener drive member in either a clockwise or counterclockwise direction about the drive axis, wherein the handle portion forms partial flanges on either side of the finger loop defining a wider neck portion extending from the finger loop towards a middle portion of the frame;

a magnet located in the fastener drive member between the openings; and a magnet housing, the magnet mounted in the magnet housing, and the magnet housing having an interference fit with the fastener drive member.

2. The ratchet wrench of claim 1 wherein one of the drive openings of the fastener drive member is configured to engage a ¼ inch hexagonal drive portion on a fastener or drive bit, and the other drive opening of the fastener drive member is configured to engage a 5/16 inch hexagonal drive portion on a fastener or drive bit.

3. The ratchet wrench of claim 1 wherein the magnet has a through bore centered on the drive axis.

4. The ratchet wrench of claim 1 wherein the magnet has a cylindrical outer surface centered on the drive axis.

5. The ratchet wrench of claim 1 wherein the fastener drive member comprises a thumb wheel having a diameter transverse to the drive axis that is greater than a maximum width of the head portion transverse to the frame and drive axes.

6. The ratchet wrench of claim 1 wherein the head portion has a maximum width transverse to the frame and drive axes, the finger receiving opening has a maximum width transverse to the frame and drive axes that is greater than the maximum width of the head, the maximum width of the head portion is no greater than ⅞ inch, and the maximum width of the finger receiving opening is no less than ⅞ inch.

7. The ratchet wrench of claim 1 wherein at least part of the handle portion has a width transverse to the frame and drive axes that is less than the maximum width of the head portion.

8. The ratchet wrench of claim 1 wherein the finger receiving opening has a circular shape.

9. The ratchet wrench of claim 1 wherein the finger loop has an arcuate outer surface that partially surrounds the finger receiving opening.

* * * * *